US009799945B2

(12) United States Patent
Murakami et al.

(10) Patent No.: US 9,799,945 B2
(45) Date of Patent: Oct. 24, 2017

(54) FOLDING ANTENNA DEVICE

(71) Applicant: Sony Corporation, Tokyo (JP)

(72) Inventors: Tomomichi Murakami, Tokyo (JP); Yoshitaka Yoshino, Tokyo (JP)

(73) Assignee: SONY CORPORATION, Tokyo (JP)

( * ) Notice: Subject to any disclaimer, the term of this patent is extended or adjusted under 35 U.S.C. 154(b) by 16 days.

(21) Appl. No.: 14/407,717

(22) PCT Filed: May 8, 2013

(86) PCT No.: PCT/JP2013/062891
§ 371 (c)(1),
(2) Date: Dec. 12, 2014

(87) PCT Pub. No.: WO2013/190927
PCT Pub. Date: Dec. 27, 2013

(65) Prior Publication Data

US 2015/0171506 A1 Jun. 18, 2015

(30) Foreign Application Priority Data

Jun. 20, 2012 (JP) ..... 2012-139079

(51) Int. Cl.
*H01Q 1/24* (2006.01)
*H01Q 21/30* (2006.01)
*H01Q 1/10* (2006.01)

(52) U.S. Cl.
CPC ..... *H01Q 1/243* (2013.01); *H01Q 21/30* (2013.01); *H01Q 1/10* (2013.01)

(58) Field of Classification Search
CPC ..... H01Q 1/243; H01Q 1/10; H01Q 21/30
See application file for complete search history.

(56) References Cited

U.S. PATENT DOCUMENTS

| | | | | |
|---|---|---|---|---|
| 5,859,617 | A * | 1/1999 | Fujikawa | H01Q 1/244 343/702 |
| 5,861,853 | A * | 1/1999 | Haub | H01Q 1/242 333/25 |
| 7,265,723 | B1 * | 9/2007 | Chan | H01Q 1/243 343/702 |
| 2003/0228891 | A1 * | 12/2003 | Kobayashi | H01Q 1/242 455/575.5 |
| 2005/0143151 | A1 * | 6/2005 | Ito | H01Q 21/28 455/575.3 |
| 2008/0024372 | A1 * | 1/2008 | Yoon | H01Q 1/243 343/702 |
| 2008/0284661 | A1 * | 11/2008 | He | H01Q 9/0421 343/700 MS |
| 2009/0109113 | A1 * | 4/2009 | Crohas | H01Q 1/242 343/788 |

(Continued)

FOREIGN PATENT DOCUMENTS

| | | |
|---|---|---|
| JP | 59-106208 | 7/1984 |
| JP | 2001-358514 | 12/2001 |

(Continued)

*Primary Examiner* — Dieu H Duong
(74) *Attorney, Agent, or Firm* — Chip Law Group

(57) ABSTRACT

There is provided a folding antenna device including a first case to which a first antenna is attached, a second case to which a second antenna is attached, and a hinge section configured to openably and closably support the first case and the second case.

11 Claims, 13 Drawing Sheets

(56) References Cited

U.S. PATENT DOCUMENTS

| | | | | |
|---|---|---|---|---|
| 2009/0131129 | A1* | 5/2009 | Yamazaki | H01Q 1/084<br>455/575.7 |
| 2010/0053005 | A1* | 3/2010 | Mukai | H01Q 1/46<br>343/720 |
| 2010/0245185 | A1* | 9/2010 | Mukai | H01Q 1/084<br>343/702 |

FOREIGN PATENT DOCUMENTS

| | | |
|---|---|---|
| JP | 2002-158517 | 5/2002 |
| JP | 2003-283224 | 10/2003 |
| JP | 2004-015348 | 1/2004 |
| JP | 2005-175667 | 6/2005 |
| JP | 2007-013442 | 1/2007 |
| JP | 2007-306347 | 11/2007 |
| JP | 2009-267680 | 11/2009 |
| JP | 2011-259414 | 12/2011 |

* cited by examiner (A)

(B)

(C)

FOLDING ANTENNA DEVICE

CROSS REFERENCES TO RELATED APPLICATIONS

The present application is a national stage of International Application No. PCT/JP2013/062891 filed on May 8, 2013 and claims priority to Japanese Patent Application No. 2012-139079 filed on Jun. 20, 2012, the disclosure of which is incorporated herein by reference.

BACKGROUND

The present disclosure relates to a folding antenna device which can be shared in the reception of radio waves in a plurality of different frequency bands.

It has been discussed that a 700-MHz band and a 900-MHz band are allocated as a frequency band of multimedia broadcasting and are used for communication of a mobile phone or the like. Also, a 200-MHz band, which is a high band of a VHS having been used in old analog television broadcasting, has already been used in multimedia broadcasting.

In the past, as an antenna for receiving both frequency bands of a VHF and a UHF indoors, a so-called rabbit ears antenna, or a combination of a folded section of a folded dipole antenna, and a circular loop antenna and a rod antenna is used. The rod antenna is used as an antenna for receiving the VHF band and the loop antenna is used as an antenna for receiving the UHF band.

Also, as an antenna that has been used in the past, there is an omnidirectional antenna for a mobile communication, which includes a rod antenna and a ground (GND). In order to obtain antenna performance in the antenna of the related art, there is a need for a length of a ½ wavelength through a combination of the rod antenna and the GND section. In particular, in a 200-MHz band that is the high band of the VHF band, a ½ wavelength is greater than or equal to 70 cm, which is inconvenient to carry.

As the prior art related to the technology of the present disclosure, there is a dual band antenna for a mobile phone, capable of receiving radio waves in different frequency bands (for example, a 800-MHz band and a 1.5-GHz band) when the antenna is housed and when the antenna is extended (see Patent Literature 1).

CITATION LIST

Patent Literature

Patent Literature 1: JP 2003-283224A

SUMMARY

Technical Problem

The antenna described in Patent Literature 1 is provided with a first metal section electrically connected to a feeder when housed, and a second metal section electrically connected to the feeder when extended. A rod-shaped metal section for adjusting an antenna characteristic is provided between the first metal section and the second metal section.

However, in the technology described in Patent Literature 1, since an antenna gain depends on an antenna length, it may be impossible to receive a radio wave of a low frequency (for example, a high band of a VHF) at which a ½ wavelength of a received radio wave exceeds the sum of a length of a case and a length of a rod antenna.

Also, it is necessary to increase the antenna gain so that a small terminal such as a mobile phone can receive a radio wave of a VHF band. Furthermore, a convenience to carry for portable use is required. The inventors have worked to design and manufacture a small antenna, including an in-vehicle antenna, but invented a compact, slim antenna this time as an application.

According to an embodiment of the present disclosure, there is provided a folding antenna device capable of receiving radio waves in a plurality of different frequency bands, including a high band (200-MHz band) of a VHF.

Solution to Problem

According to an embodiment of the present disclosure, there is provided a folding antenna device including a first case to which a first antenna is attached, and a second case to which a second antenna is attached. Also, the folding antenna device includes a hinge that openably and closably supports the first case and the second case, and the hinge is configured to fold the first case and the second case.

The first antenna and/or the second antenna can take two states: a state of being housed in the first case or the second case and a state of being pulled out from the first case.

Advantageous Effects of Invention

According to the present disclosure, it is possible to realize an antenna having a good gain characteristic in a small space. Also, it is possible to receive radio waves in a plurality of different frequency bands, including a UHF band and a high band (200-MHz band) of a VHF.

Additional features and advantages are described herein, and will be apparent from the following Detailed Description and the figures.

DETAILED DESCRIPTION

Hereinafter, with reference to the drawings, folding antennas according to embodiments of the present invention will be described with reference to FIGS. 1 to 14. Note that description will be provided in the following order.

<1. Description of First Embodiment>

[Configuration of Folding Antenna of First Embodiment]

[Frequency-Peak Gain Characteristic of Folding Antenna of First Embodiment]

[Noise Characteristic of Folding Antenna of First Embodiment]

<2. Description of Second Embodiment>

[Configuration of Folding Antenna of Second Embodiment]

[Frequency-Peak Gain Characteristic of Folding Antenna of Second Embodiment]

1. Description of First Embodiment

A first embodiment (hereinafter, also referred to as "present example") of a folding antenna of the present disclosure will be described below with reference to FIGS. 1 and 2.

[Configuration of Folding Antenna]

Figure 1:
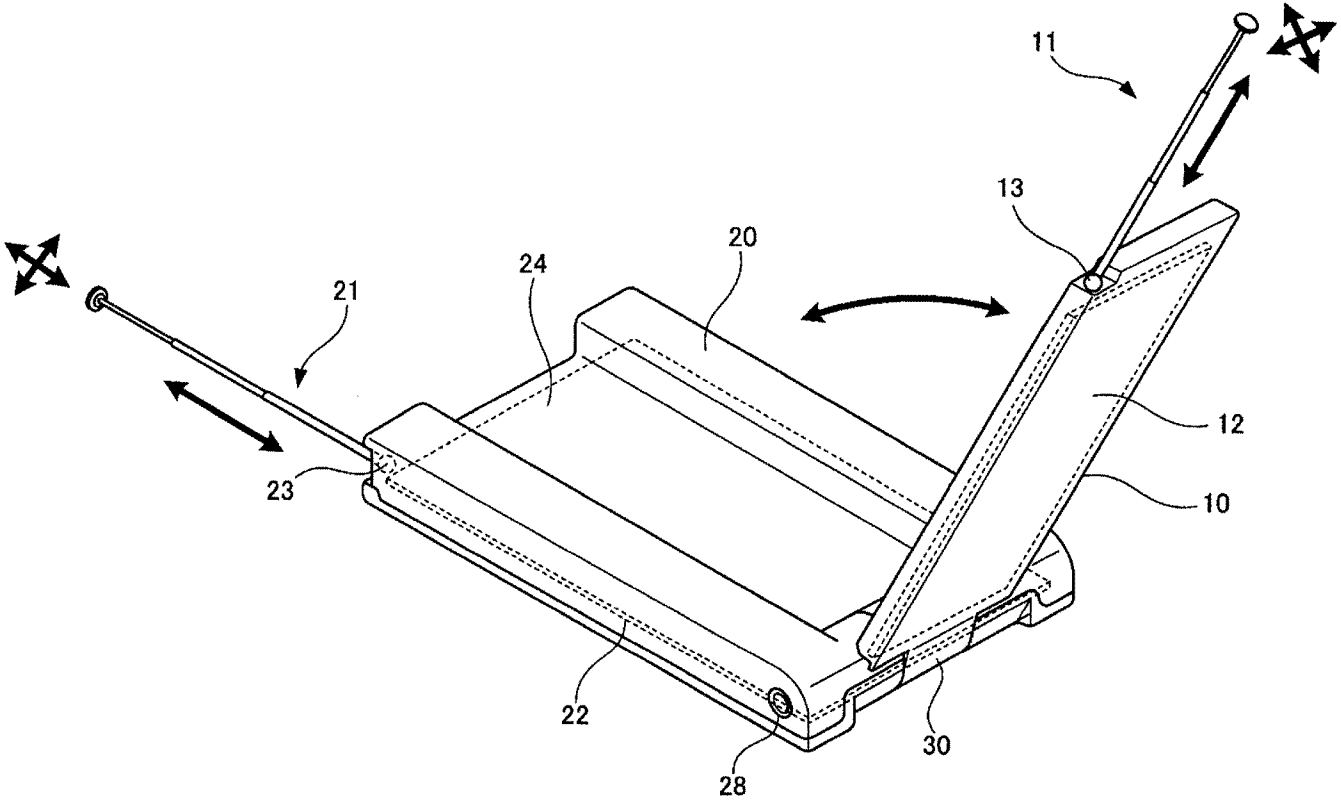
FIG. 1 is a diagram illustrating a schematic configuration of a folding antenna according to a first embodiment of the present disclosure.

FIG. 1 illustrates a schematic configuration of a folding antenna of the present example. As illustrated in FIG. 1, the folding antenna of the present example includes a first case 10 and a second case 20 that are foldable. That is, the first case 10 and the second case 20 can be opened and closed from 0 degree to 180 degrees around a hinge section 30. The first case 10 and the second case 20 is locked by a locking member (not illustrated) when an angle between the first case and the second case is 90 degrees and 180 degrees. Also, in the second case 20, a depressed section 24 is formed such that the first case 10 can be housed as nesting. Since the folding antenna, in which the two cases 10 and 20 have a nested structure, can reduce a thickness, the folding antenna can be made compact as a portable antenna.

Also, substrates 12 and 22 are housed in the first case 10 and the second case 20, respectively, and the substrates 12 and 22 also function as a part of the antenna. The substrates 12 and 22 are formed to have sizes corresponding to sizes of the cases 10 and 20 in which the substrates 12 and 22 are housed, respectively. The whole antenna characteristics, including the sizes of the substrates 12 and 22, are determined. However, since the first case 10 and the second case 20 have the nested structure, the size of the substrate 12 provided in the first case 10 is smaller than the size of the substrate 22 provided in the second case 20. Here, the substrate 12 is referred to as a first substrate and the substrate 22 is referred to as a second substrate.

Although not illustrated in FIG. 1, a space for housing a rod antenna 11 is provided at an edge of the first case 10. Also, a space, in which a rod antenna 21 is housed, is provided at an edge of the second case 20. The rod antenna 11 constitutes a first antenna element (first antenna) of a dipole antenna and the rod antenna 21 constitutes a second antenna element (second antenna).

The rod antenna 11 and the rod antenna 21 are configured in a multi-stage nested shape and are retractable. In the rod antenna 11 and the rod antenna 21, universal joints 13 and 23 are provided in the initial stage (case side) of the nested shape, such that the directions of the rod antennas 11 and 21 can be freely rotated 360 degrees.

For example, the sizes of the respective sections constituting the folding antenna of the present example can be set to the following sizes. For example, the size of the case, in which the first case 10 is housed in the depressed section 24 of the second case 20, has a width of 60 mm, a length of 99.5 mm, and a height of 14.5 mm. Also, when the rod antennas 11 and 21 are in an extended state, a length from each case edge to an antenna front end is 140 mm. Also, as illustrated in FIG. 1, a high-frequency connector 28 of ϕ2.5 mm is provided in the second case 20. This connector is a connector that is mainly used for audio purpose.

Here, when the first case 10 and the second case 20 are opened 180 degrees and the rod antennas 11 and 21 of 140 mm are extended, the total length (physical length) of the antenna is approximately 480 mm. This value is considerably shorter than 750 mm corresponding to a ½ wavelength of 200 MHz. The reason why the high band (200 MHz) of the VHF band can be received with the length of 480 mm will be described below, but this can be achieved by the insertion of loading coils between the rod antenna and the coaxial cable (see FIG. 2).

Figure 2:
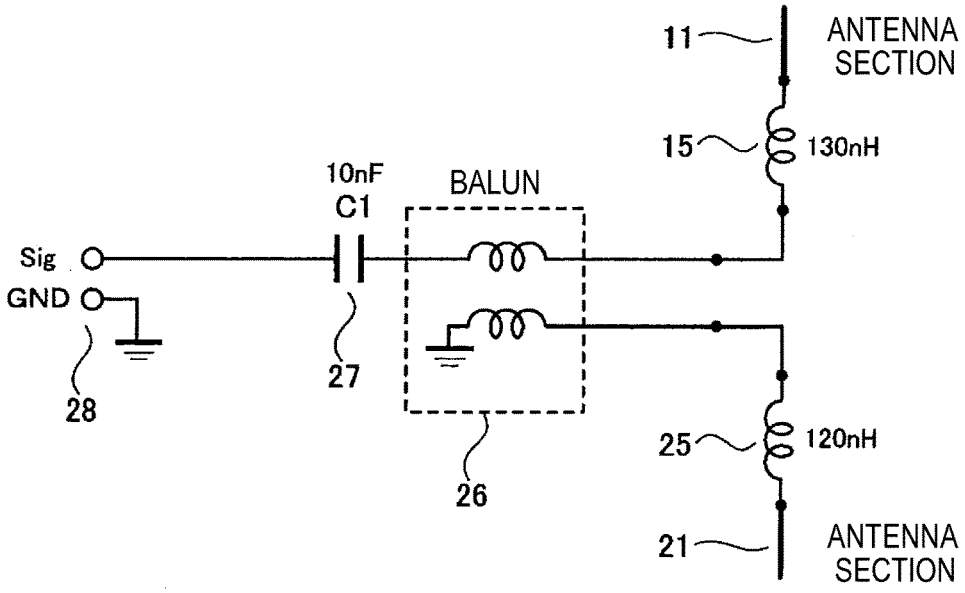
FIG. 2 is a diagram illustrating an antenna and an internal circuit configuration used in a first embodiment of the present disclosure.
Figure 3:
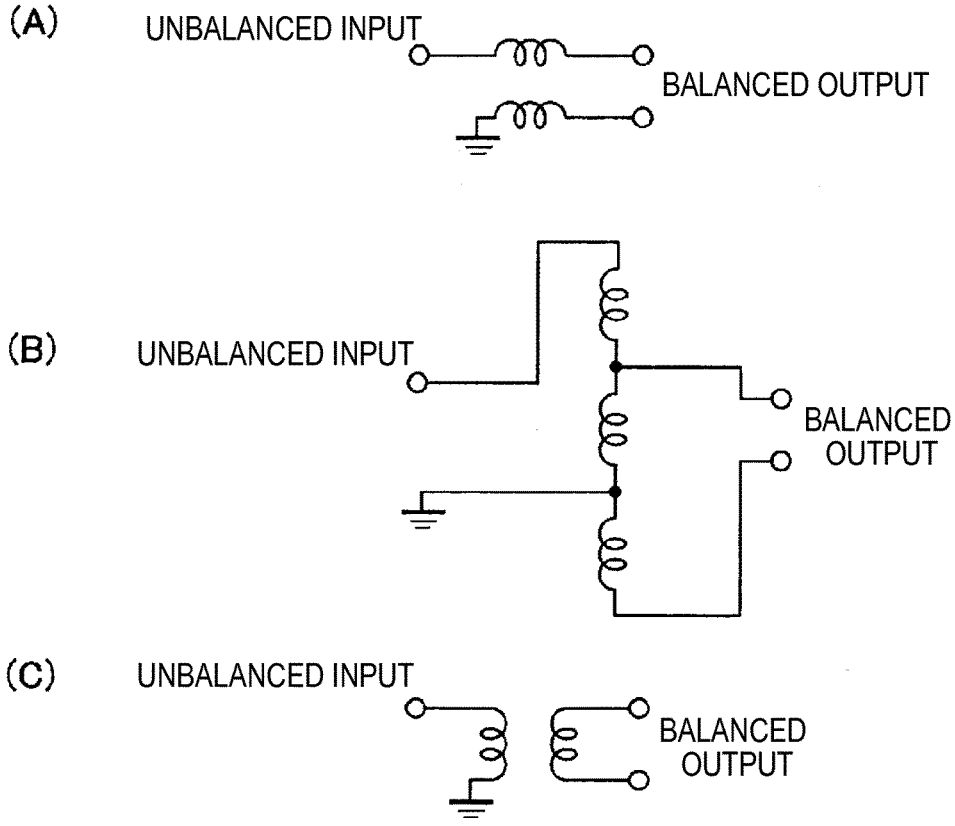
FIGS. 3(A), 3(B), and 3(C) are diagrams illustrating an example of a balun used in a folding antenna according to the present disclosure.

FIG. 2 is an internal circuit diagram of the first case 10 and the second case 20 used in the folding antenna of the present example. This circuit itself is substantially the same as a circuit diagram of a typical antenna and is not unique to the folding antenna of the present example. As described above, the folding antenna of the present example constitutes a dipole antenna by the rod antenna 11 and the rod antenna 21. Loading coils 15 and 25 are connected to the rod antennas 11 and 21, respectively. The loading coil 15 is provided in the first case 10 to be nested, and an inductance of the loading coil 15 is 130 nH. The loading coil 25 is provided in the second case 20, and an inductance of the loading coil 25 is 120 nH, which is slightly smaller than the loading coil 15.

The loading coils 15 and 25 are also referred to as extension coils, are inserted in the middle of the respective antenna elements of the dipole antenna, and have a function of reducing the physical length of the antenna. The reason why the coils for reduction are referred to as the extension coils is because the coils have a function of electrically extending the reduced physical length. The electrically extended length is referred to as an electrical length.

The inductance of the loading coil 15 is 130 nH and the inductance of the loading coil 25 is 120 nH. In this way, the values are changed. This is because the size of the first substrate 12 disposed in the first case 10 is different from the size of the second substrate 22 disposed in the second case 20. In a case where the physical length, including the sizes of the substrates 12 and 22 and the loading coils 15 and 25 connected thereto, is converted to the electrical length, the values of the loading coils 15 and 25 are determined such that the electrical length of each element constituting the dipole antenna becomes an approximately ¼ wavelength of a radio wave to be received.

Also, as illustrated in FIG. 2, a balun 26 is connected to the rod antennas 11 and 21, and the balun 26 is connected to a terminal 28 that is connected to a coaxial cable (not illustrated) through a DC cutting capacitor 27. The balun 26 is a balance-unbalance converter configured to connect an antenna of a balance side and a coaxial cable of an unbalance side that is connected to the terminal 28, and is also a sorter balun or a float balun. If the balun 26 is omitted, a conductor of one side constituting the coaxial cable can operate as an antenna. Thus, a directivity may be distorted and a gain may be lowered.

As such, the balun 26 has a function of suppressing a noise from a set terminal that is connected to the antenna through the coaxial cable. That is, by connecting the balun 26, an unbalanced (common mode) noise from a set case can be suppressed from being induced in the antenna. This is because a signal from the substrates 12 and 22 and the coaxial cable of the unbalance side is unbalance-balance converted and is transmitted to the antenna side.

If the balun 26 is used as described above, the unbalance of the coaxial cable side can be efficiently converted to the balance of the antenna side. For example, in a case where the dipole antenna is directly connected to the coaxial cable, a balanced signal is induced in a ground side and a core side of the coaxial cable on an antenna feeder side. The induced balanced signal propagates through the coaxial cable and becomes an unbalanced signal at a portion (device connection point) of the coaxial cable connecting a device. The device connection point is a true GND point of the coaxial cable, and a signal amplitude induced in a GND of a cladding section is increased from the true GND point toward an antenna feeding point. That is, an impedance for the GND is increased from the device connection point of the coaxial cable toward the antenna feeding point.

As described above, since the coaxial cable itself also has the balance-unbalance conversion function, the balun 26 of FIG. 2 is not an essential component necessary to constitute the folding antenna of the present example. However, it is obvious that the insertion of the balun 26 as illustrated in FIG. 2 improves the characteristic of the antenna. In the present example, the balun 26 (sorter balun) functioning as the balance-unbalance converter, in which the number of windings is 1:1, is used. An example of the balun is illustrated in FIGS. 3(A) to 3(C), baluns having various configurations have been known and an optimal balun is selected from these baluns according to purpose. For example, a sorter balun of FIG. 3(A) is mainly used for removal of a common mode noise, but baluns illustrated in FIGS. 3(B) and 3(C) are mainly used when it is necessary to perform impedance conversion according to a magnitude of an impedance of a circuit to be connected.

FIGS. 4(A) and 4(B) are an appearance diagram and an internal configuration diagram, respectively, when the first case 10 and the second case 20 of the folding antenna of the present example are opened 180 degrees. The rod antenna 11, the substrate 12, and the loading coil 15 are disposed in the first case 10 and are electrically connected to one another. Also, the substrate 22 is disposed in the second case 20, and the rod antenna 21 and the loading coil 25 (see FIG. 2) are connected to each other. Also, the loading coil 25 is connected to the balun 26. The balun 26 is connected to the substrate 22 disposed in the second case 20.

Figure 4:
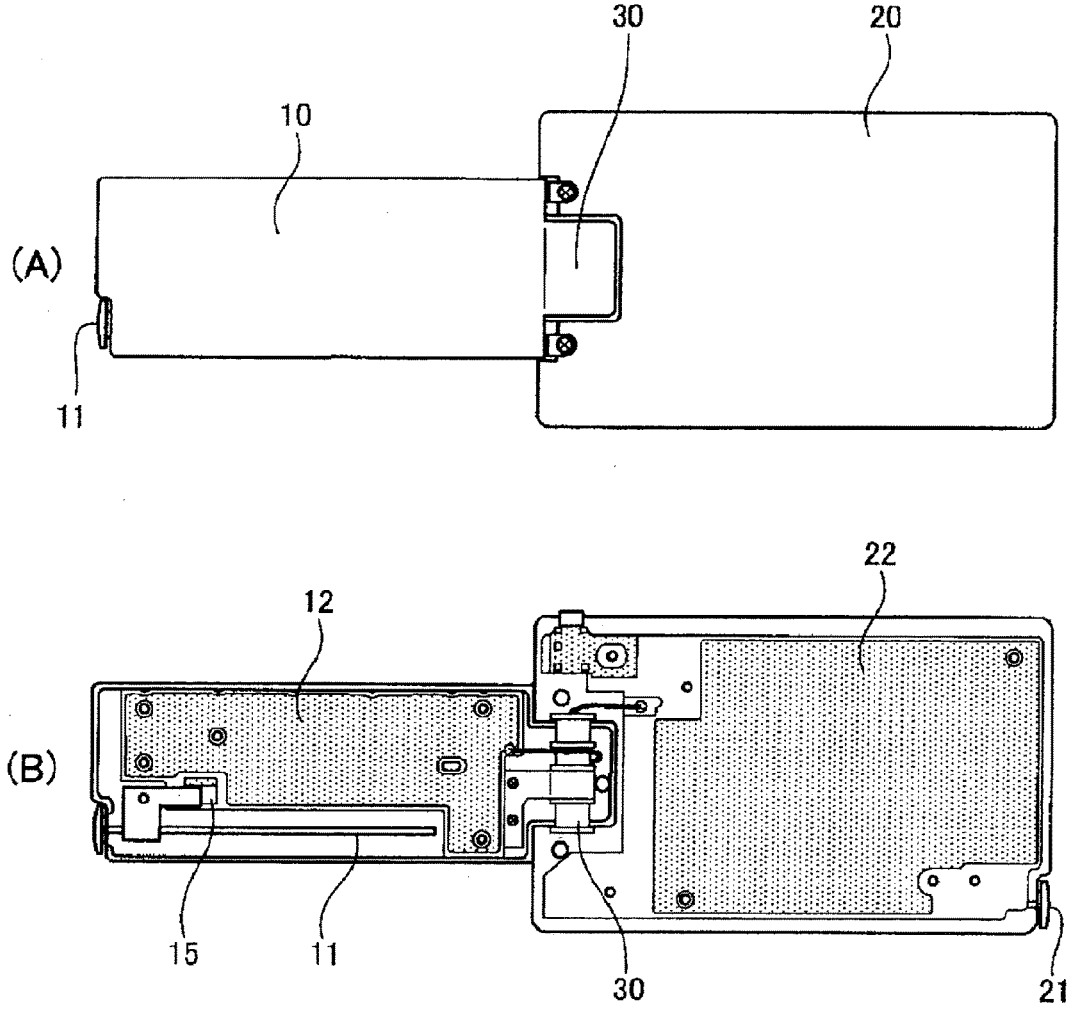
FIGS. 4(A) and 4(B) are an appearance diagram and an internal configuration diagram, respectively, when a folding antenna used in a first embodiment of the present disclosure is opened 180 degrees.
Figure 5:
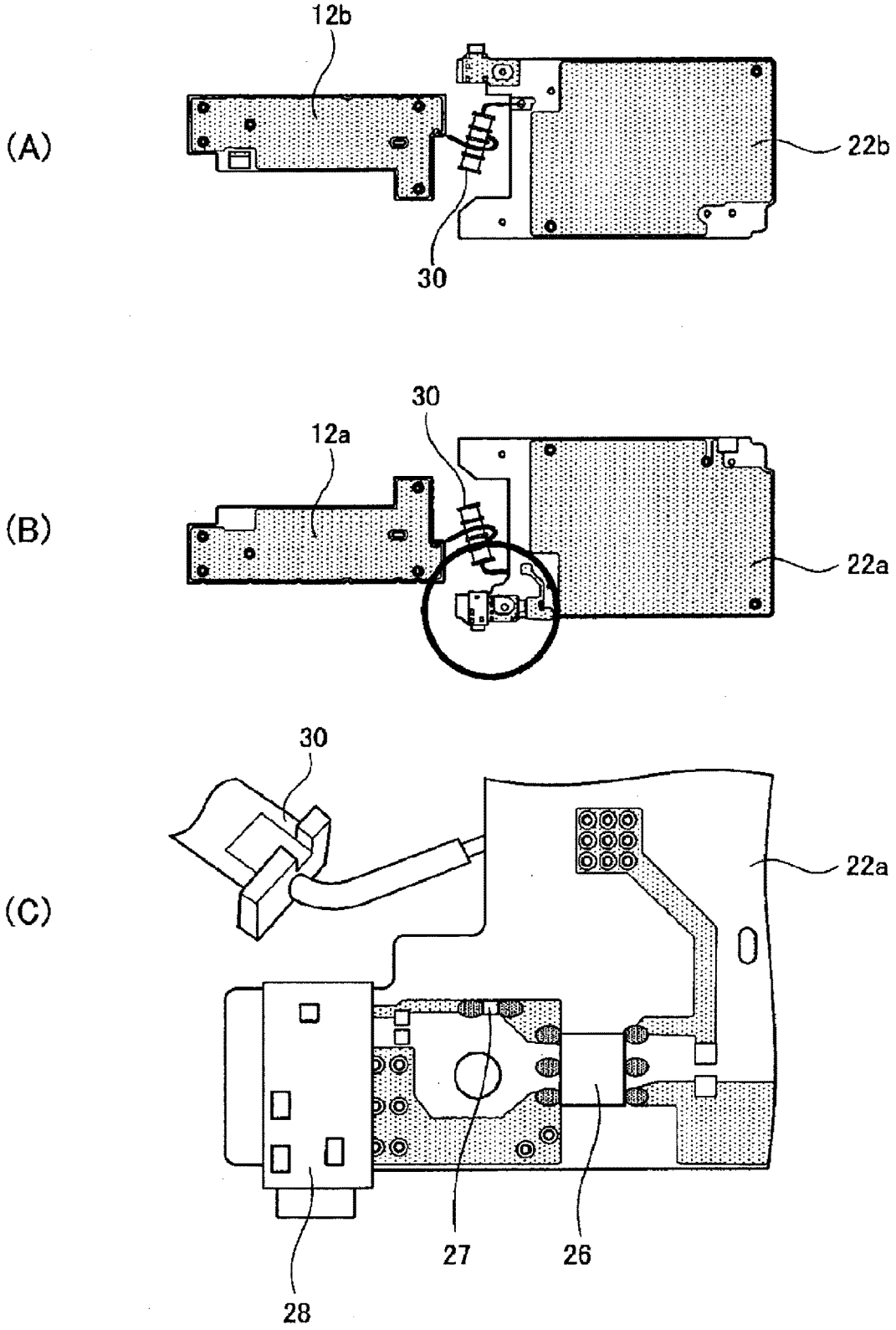
FIGS. 5(A), 5(B), and 5(C) are diagrams illustrating a connection relationship between an antenna according to a first embodiment of the present disclosure and a substrate in a case.
Figure 6:
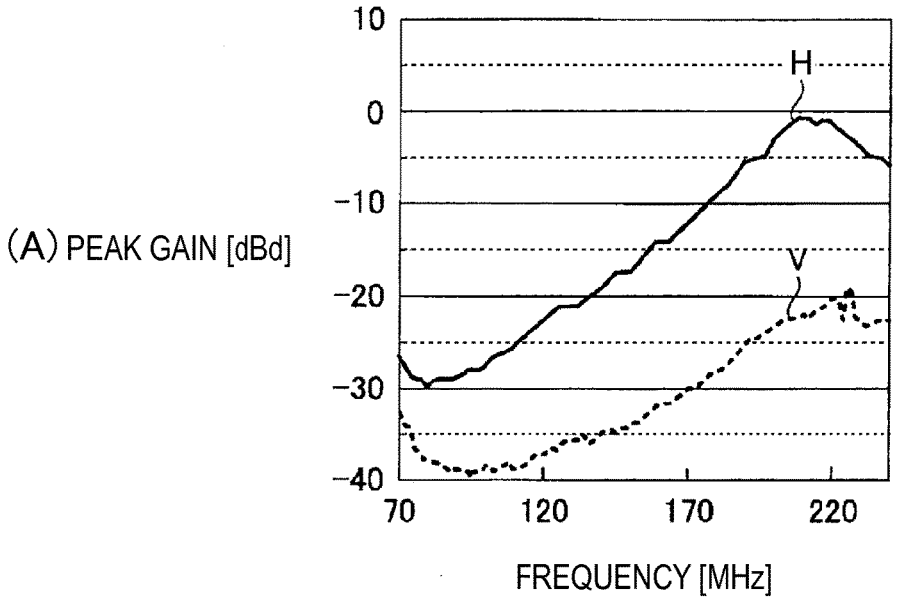
FIGS. 6(A) and 6(B) are diagrams illustrating frequency-peak gain characteristics of a VHF band and a UHF band when a first case and a second case of a folding antenna according to a first embodiment of the present disclosure are opened 180 degrees and a rod antenna is extended.
Figure 6:
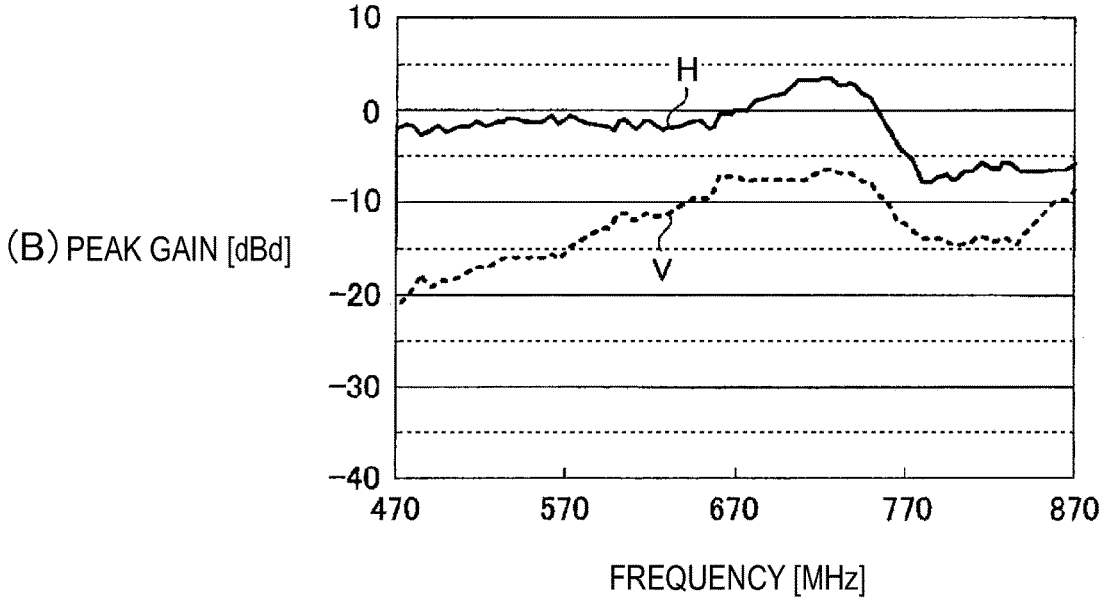
Figure 7:
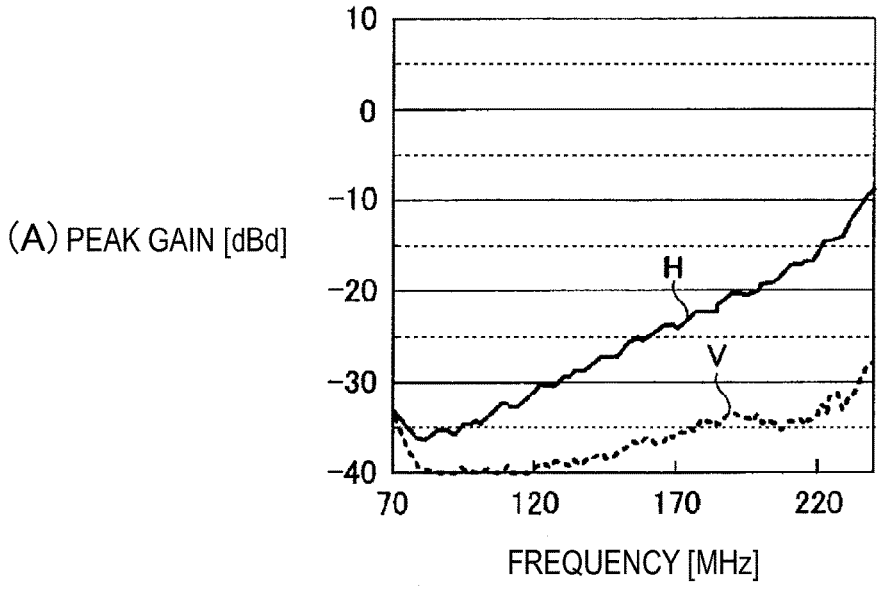
FIGS. 7(A) and 7(B) are diagrams illustrating frequency-peak gain characteristics of a VHF band and a UHF band, as comparative example, when a first case and a second case of a folding antenna according to a first embodiment of the present disclosure are opened 180degrees and rod antennas are housed.
Figure 7:
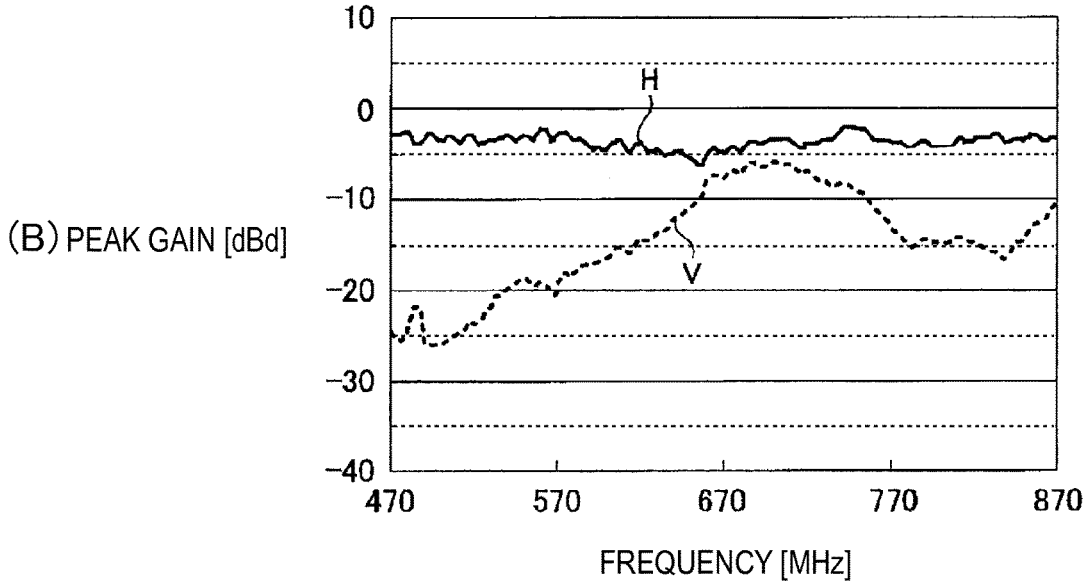
Figure 8:
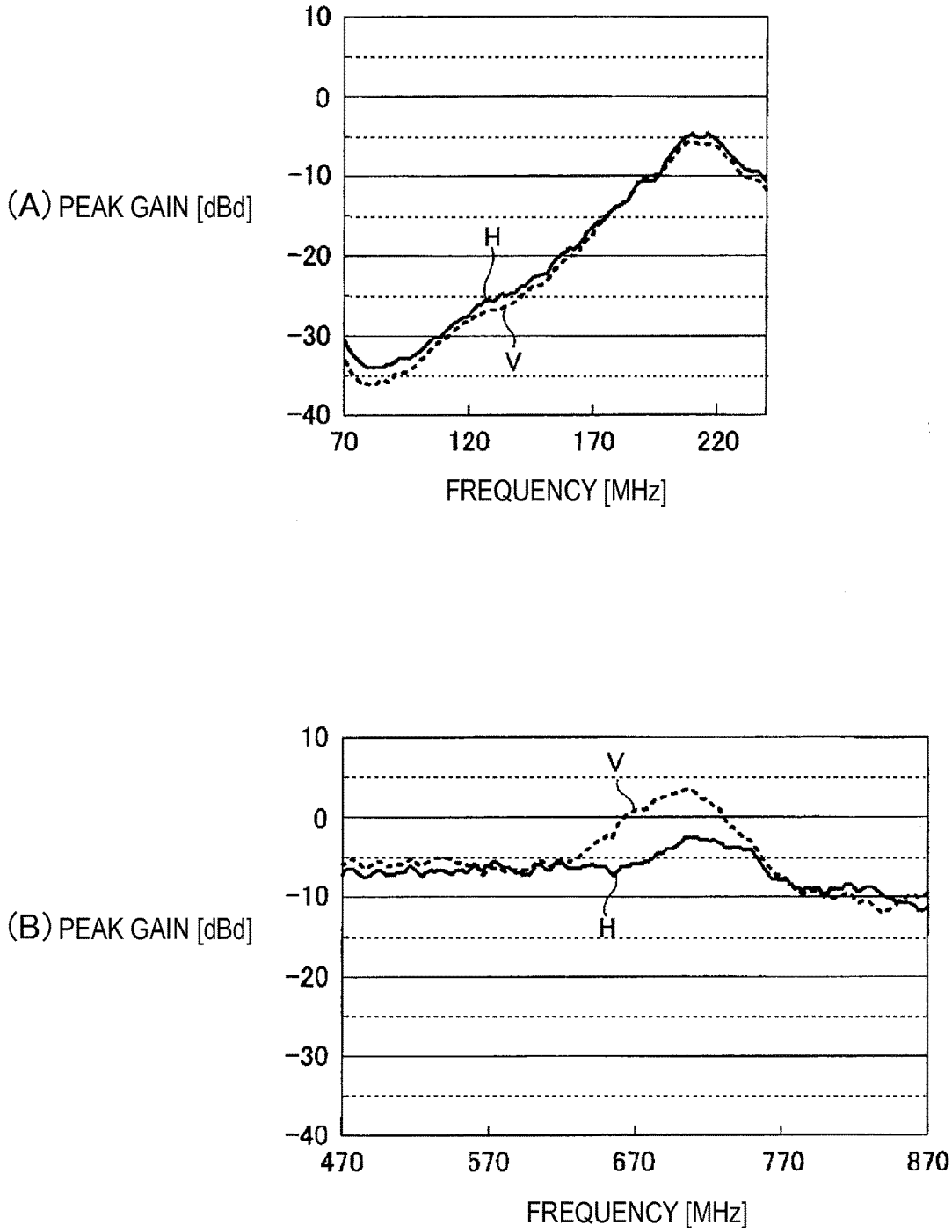
FIGS. 8(A) and 8(B) are diagrams illustrating frequency-peak gain characteristics of a VHF band and a UHF band when a first case and a second case of a folding antenna according to a first embodiment of the present disclosure are opened in an approximately 90-degree L shape and rod antennas are extended.

A state in which the rod antennas 11 and 21 are housed in the cases 10 and 20 is illustrated in FIG. 4, but the physical length from the front end of the rod antenna 11 to the front end of the rod antenna 21 when extended is approximately 480 mm. On the other hand, in a state in which the rod antennas 11 and 21 are housed as illustrated in FIG. 4, the physical length from the front end of the first case 10 to the front end of the second case 20 is approximately 200 mm.

The electrical length is extended when the loading coils 15 and 25 functioning as the extension coils are inserted between the substrates 12 and 22 and the rod antennas 11 and 21 within the first case 10 and the second case 20. As described below with reference to FIG. 6, a UHF band can be received in a state in which the rod antennas 11 and 21 are housed, and a high band (200-MHz band) of a VHF band can be received in a state in which the rod antennas 11 and 21 are extended.

FIGS. 5(A) to 5(C) are diagrams illustrating a connection of the substrate 12 and the substrate 22 and an electrical connection relationship of the balun 26, the capacitor 27, and the high-frequency connector 28, when the first case 10 and the second case 20 are opened 180 degrees in the folding antenna of the present example as illustrated in FIG. 4. FIG. 5(C) is an enlarged view of a black ○ mark of FIG. 5(B).

In FIGS. 5(A) to 5(C), surfaces of the substrates 12 and 22 (these are referred to as "front surfaces") are indicated by 12*a* and 22*a*, and the other surfaces of the substrates 12 and 22 (these are referred to as "rear surfaces") are indicated by 12*b* and 22*b*. The front surfaces 12*a* and 22*a* of the substrates 11 and 22 are electrically connected to the rear surfaces 12*b* and 22*b*.

As illustrated in FIGS. 5(A) and 5(B), the substrate 12 disposed in the first case 10 and the substrate 22 disposed in the second case 20 are connected through the hinge section 30 by conducting wires. Also, as illustrated in FIG. 5(C), the second substrate 22 is connected to the high-frequency connector 28 of ϕ2.5 mm through the balun 26 and the capacitor 27. When connected in this manner, as described below, the first case 10 and the second case 20 have the function as the antenna in a state in which the substrates 12 and 22 disposed in the insides thereof and the rod antennas 11 and 21 are combined.

<Frequency-Peak Gain Characteristic of Folding Antenna of Present Example>

[Frequency-Peak Gain Characteristic when the Cases are Opened 180 Degrees]

FIGS. 6(A) and 6(B), Table 1, and Table 2 show the frequency-peak gain characteristic of the antenna when the first case 10 and the second case 20 in the folding antenna of the present example are opened 180 degrees and the rod antennas 11 and 21 are extended. Table 1 and FIG. 6(A) show the frequency-peak gain characteristic of the VHF band, and Table 2 and FIG. 6(B) show the frequency-peak gain characteristic of the UHF band. In FIGS. 6A and 6B, a solid line represents a horizontal polarization H and a dashed line represents a vertical polarization V.

TABLE 1

| Frequency [MHz] | 188.5 | 192.5 | 194.5 | 198 | 204 | 210 | 216 | 222 |
|---|---|---|---|---|---|---|---|---|
| | Vertical Polarization (V) | | | | | | | |
| Peak [dBd] | −25.49 | −24.67 | −24.45 | −23.75 | −22.63 | −22.24 | −21.23 | −20.46 |
| | Horizontal Polarizatin (H) | | | | | | | |
| Peak [dBd] | −5.74 | −5.10 | −4.97 | −3.75 | −1.71 | −0.95 | −1.05 | −2.02 |

TABLE 2

| Frequency [MHz] | 470 | 520 | 570 | 620 | 670 | 720 | 770 | 906 |
|---|---|---|---|---|---|---|---|---|
| | Vertical Polarization (V) | | | | | | | |
| Peak [dBd] | −21.86 | −17.35 | −15.56 | −11.78 | −7.84 | −6.94 | −12.70 | −7.37 |
| | Horizontal Polarizatin (H) | | | | | | | |
| Peak [dBd] | −2.26 | −1.86 | −1.06 | −1.65 | −0.24 | 3.24 | −5.10 | −6.12 |

As can be seen from FIG. 6(A) and Table 1, a gain of −10 dBd or more is obtained in a horizontal polarization H being a main polarization around 170 to 220 MHz being the high band of the VHF band. Here, unit (dBd) is a decibel value when compared with a dipole antenna of a full half-wavelength.

Also, it can be seen from FIG. 6(B) and Table 2 that a gain of −10 dBd or more is ensured in a horizontal polarization H over the entire band of the UHF band of 470 to 900 MHz. It can be seen that a high gain is also obtained in a vertical polarization V around 670 to 770 MHz.

FIGS. 7(A) and 7(B), Table 3, and Table 4 show the frequency-peak gain characteristics of the antenna, as comparative example, when the first case 10 and the second case 20 of the folding antenna of the present example are opened 180 degrees and the rod antennas 11 and 21 are housed in the cases 10 and 20, respectively.

FIG. 7(A) and Table 3 show the frequency-peak gain characteristic of the VHF band, and FIG. 7(B) and Table 4 show the frequency-peak gain characteristic of the UHF band.

TABLE 3

| Frequency [MHz] | 188.5 | 192.5 | 194.5 | 198 | 204 | 210 | 216 | 222 |
|---|---|---|---|---|---|---|---|---|
| | Vertical Polarization (V) | | | | | | | |
| Peak [dBd] | −33.74 | −34.00 | −34.05 | −34.33 | −34.38 | −34.55 | −34.76 | −32.66 |
| | Horizontal Polarizatin (H) | | | | | | | |
| Peak [dBd] | −20.74 | −20.47 | −20.53 | −20.18 | −19.27 | −17.57 | −17.03 | −14.98 |

TABLE 4

| Frequency [MHz] | 470 | 520 | 570 | 620 | 670 | 720 | 770 | 906 |
|---|---|---|---|---|---|---|---|---|
| | Vertical Polarization (V) | | | | | | | |
| Peak [dBd] | −24.99 | −23.75 | −19.26 | −14.58 | −7.79 | −7.16 | −13.30 | −7.77 |
| | Horizontal Polarizatin (H) | | | | | | | |
| Peak [dBd] | −3.12 | −3.77 | −3.16 | −4.38 | −5.24 | −4.16 | −4.10 | −4.97 |

As can be seen from FIG. 7(A) and Table 3, when the rod antennas 11 and 21 are housed in the cases 10 and 20, respectively, a gain of −10 dBd or more cannot be obtained in the VHF band in a horizontal polarization H and a vertical polarization V. On the other hand, as can be seen from FIG. 7(B) and Table 4, even when the rod antennas 11 and 21 are housed in the cases 10 and 20, respectively, a gain of −10 dBd or more is obtained at the entire bandwidth of the horizontal polarization H in the UHF band. Also, even in the vertical polarization V, a gain of −10 dBd or more is obtained at 670 MHz to 720 MHz.

Therefore, if the rod antennas 11 and 21 in the folding antenna of the present example are pulled out from the cases 10 and 20, respectively, both the UHF band and the VHF band can be received. However, if the rod antennas 11 and 21 are housed in the cases 10 and 20, respectively, the radio wave of the UHF band can be received, but the radio wave of the VHF cannot be received.

[Frequency-Peak Gain Characteristic when Opened in 90-Degree L Shape]

FIGS. 8(A) and 8(B), Table 5, and Table 6 show the frequency-peak gain characteristic of the antenna when the first case 10 and the second case 20 in the folding antenna of the present example are opened in a 90-degree L shape and the rod antennas 11 and 21 are extended. FIG. 8(A) and Table 5 show the frequency-peak gain characteristic of the VHF band, and FIG. 8(B) and Table 6 show the frequency-peak gain characteristic of the UHF band.

TABLE 5

| Frequency [MHz] | 188.5 | 192.5 | 194.5 | 198 | 204 | 210 | 216 | 222 |
|---|---|---|---|---|---|---|---|---|
| | Vertical Polarization (V) | | | | | | | |
| Peak [dBd] | −10.94 | −10.47 | −10.45 | −9.38 | −7.15 | −5.95 | −6.23 | −6.97 |
| | Horizontal Polarizatin (H) | | | | | | | |
| Peak [dBd] | −11.14 | −10.67 | −10.65 | −9.18 | −6.75 | −5.15 | −5.03 | −6.32 |

TABLE 6

| Frequency [MHz] | 470 | 520 | 570 | 620 | 670 | 720 | 770 | 906 |
|---|---|---|---|---|---|---|---|---|
| | Vertical Polarization (V) | | | | | | | |
| Peak [dBd] | −6.39 | −6.17 | −6.86 | −5.72 | 0.36 | 1.44 | −7.90 | −9.97 |
| | Horizontal Polarizatin (H) | | | | | | | |
| Peak [dBd] | −7.19 | −7.17 | −6.26 | −6.32 | −6.24 | −3.34 | −8.10 | −11.97 |

It can be seen from FIGS. 8(A) and 8(B), Table 5, and Table 6 that, when an angle between the first case 10 and the second case 20 is disposed in an approximately 90-degree L shape, the frequency characteristics of the horizontal polarization H and the vertical polarization V in both the VHF band and the UHF band are very similar to each other. As can be seen from FIG. 8(A) and Table 5, a gain of −10 dBd or more can be ensured in both the horizontal polarization H and the vertical polarization V, in particular, around 200 to 220 MHz being the high band of the VHF band. Also, it can be seen from FIG. 8(B) and Table 6 that a gain of −10 dBd or more is ensured in a horizontal polarization H and a vertical polarization V over the entire band of the UHF band of 470 to 900 MHz.

FIGS. 9(A) and 9(B), Table 7, and Table 8 show the frequency-peak gain characteristic of the antenna when the first case 10 and the second case 20 in the folding antenna of the present example are opened in a 90-degree L shape and the rod antennas 11 and 21 are housed in the cases. FIG. 9(A) and Table 7 show the frequency-peak gain characteristic of the VHF band, and FIG. 9(B) and Table 8 show the frequency-peak gain characteristic of the UHF band.

TABLE 7

| Frequency [MHz] | 188.5 | 192.5 | 194.5 | 198 | 204 | 210 | 216 | 222 |
|---|---|---|---|---|---|---|---|---|
| | Vertical Polarization (V) | | | | | | | |
| Peak [dBd] | −24.84 | −24.70 | −24.85 | −24.20 | −23.43 | −21.77 | −21.43 | −19.54 |
| | Horizontal Polarizatin (H) | | | | | | | |
| Peak [dBd] | −24.69 | −24.27 | −24.48 | −23.95 | −22.71 | −21.46 | −21.23 | −19.34 |

TABLE 8

| Frequency [MHz] | 470 | 520 | 570 | 620 | 670 | 720 | 770 | 906 |
|---|---|---|---|---|---|---|---|---|
| | Vertical Polarization (V) | | | | | | | |
| Peak [dBd] | −8.79 | −9.26 | −11.36 | −10.18 | −5.24 | −5.74 | −14.30 | −9.12 |
| | Horizontal Polarizatin (H) | | | | | | | |
| Peak [dBd] | −7.79 | −8.57 | −8.56 | −9.52 | −10.04 | −8.56 | −8.70 | −10.52 |

As can be seen from FIGS. 9(A) and 9(B), even in this case, the frequency-peak gain characteristics of the horizontal polarization H and the vertical polarization V tend to be similar to each other. As can be seen from FIG. 9(A) and Table 7, when the rod antennas 11 and 21 are housed in the cases 10 and 20, respectively, a gain of −10 dBd or more cannot be obtained in the VHF band. On the other hand, as can be seen from FIG. 9(B) and Table 8, even when the rod antennas 11 and 21 are housed in the cases 10 and 20, respectively, a gain of −10 dBd or more is obtained over the entire UHF band in both the horizontal polarization H an the vertical polarization V.

Figure 9:
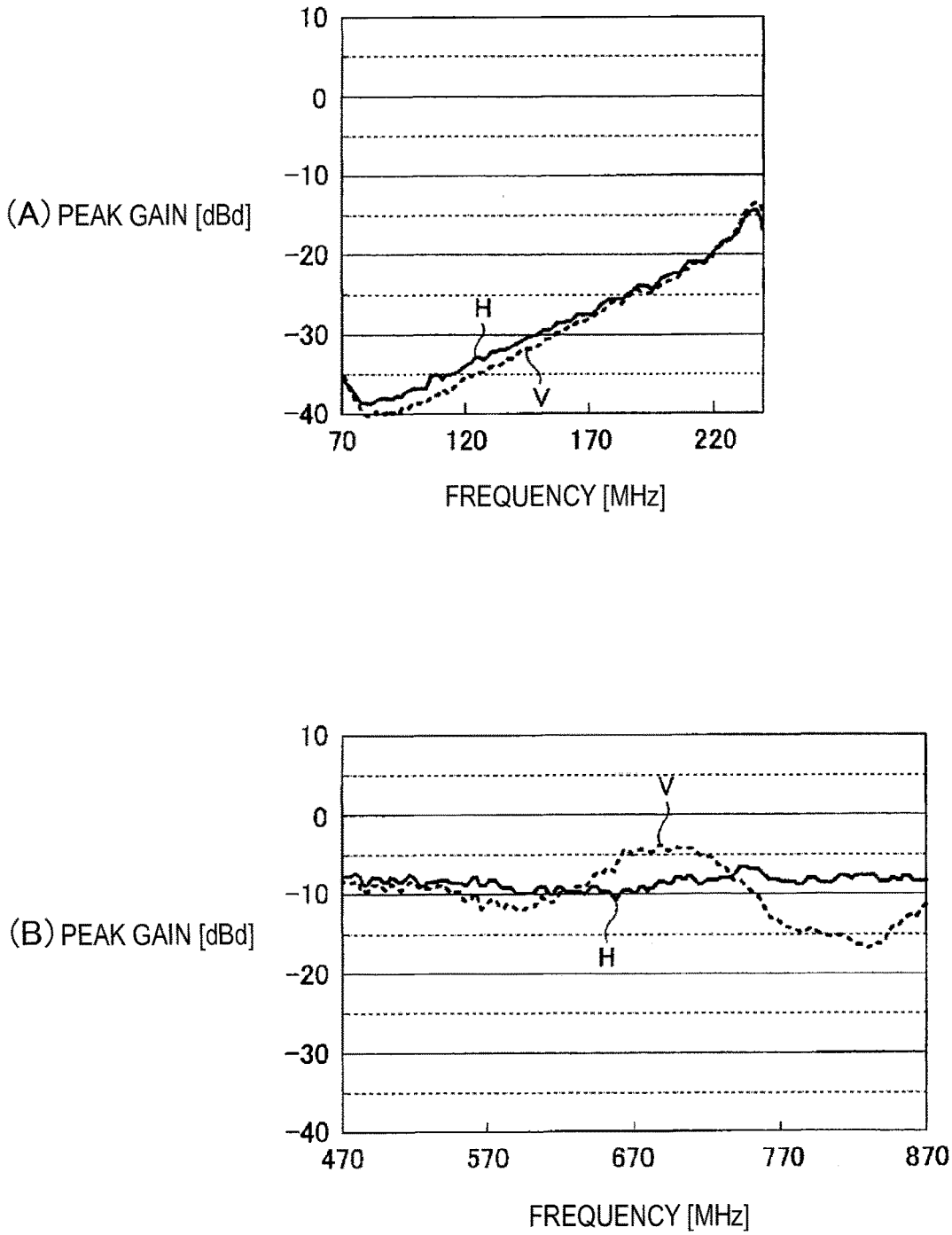
FIGS. 9(A) and 9(B) are diagrams illustrating frequency-peak gain characteristics of a VHF band and a UHF band when a first case and a second case of a folding antenna according to a first embodiment of the present disclosure are opened in an approximately 90-degree L shape and rod antennas are housed.
Figure 10:
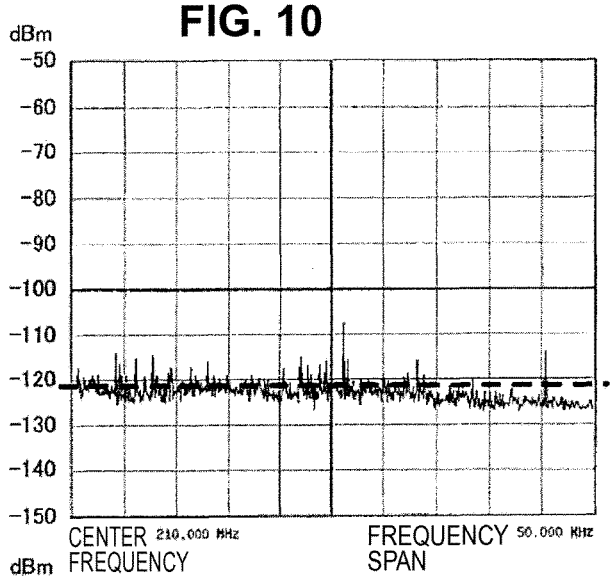
FIGS. 10(A), 10(B), and 10(C) are diagrams illustrating a noise floor characteristic in a case (A) where a balun is input to set a length of a coaxial cable as 15 cm in the circuit configuration of FIG. 2, a noise floor characteristic in a case (B) where a balun is not input in the circuit configuration of FIG. 2, and a noise floor characteristic in a case (C) where a balun is input to set a length of a coaxial cable as 75 cm.
Figure 10:
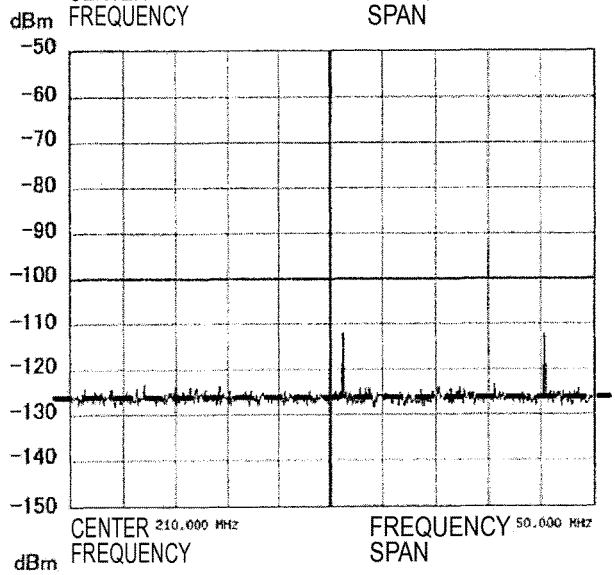
Figure 10:
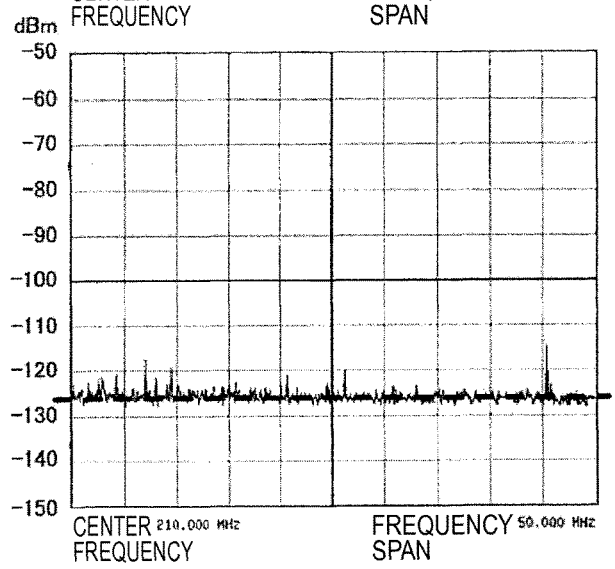

As can also be seen from FIG. 9, when the rod antennas 11 and 21 are extended, both the UHF band and the VHF band can be received; however, when the rod antennas 11 and 21 are housed in the cases 10 and 20, respectively, the radio wave of the UHF band can be received, but the radio wave of the VHF cannot be received.

<Noise Characteristic of Folding Antenna of First Embodiment>

FIGS. 10(A) to 10(C) are diagrams illustrating a noise floor characteristic at an antenna output in a no-signal state. A vertical axis represents a noise level (dBm) and a horizontal axis represents a frequency. Here, the noise floor is a noise level when no signal is input. dBm, which is unit of the vertical axis, is 0 dBm=1 mW with respect to the output of 1 mW. Therefore, −120 dBm means that the noise level is 1/120 of 1 mW.

FIG. 10(A) shows a noise level when the balun 26 is not inserted, and FIG. 10(B) shows a noise level when the balun is inserted. In both cases, the length of the coaxial cable is 150 mm.

FIG. 10(C) shows a noise level measured when the length of the coaxial cable is 750 mm and the balun 26 is inserted. As illustrated in FIGS. 10(B) and 10(C), it can be seen that the noise floor is lowered by inserting the balun 26. As such, when the noise floor is lowered by inserting the balun 26, a dynamic range of a signal can be enlarged and a signal-to-noise ratio (S/N ratio) is improved, resulting in an increase in a gain of an amplifier.

In FIG. 10(A) in which the balun 26 is not inserted, a noise level indicated by a dashed line is −122 to −123 dBm. On the other hand, in FIGS. 10(B) and 10(C) in which the balun is inserted, a noise level indicated by a solid line is −126 to −127 dBm. Therefore, in FIGS. 10(B) and 10(C), it can be seen that a noise characteristic is improved by only 3 to 4 dBm as compared with the case of FIG. 10(A) in which the balun is not inserted.

As illustrated in FIG. 10(C), since the noise floor characteristic is hardly deteriorated even when the cable length is increased to 750 mm, the effect obtained by the insertion of the balun can be sufficiently confirmed. As such, not only getting the antenna gain but also suppressing the noise is very important so as to obtain a better reception sensitivity.

<2. Description of Second Embodiment>

Next, a second embodiment of the folding antenna of the present disclosure will be described with reference to FIGS. 11 and 12.

Figure 11:
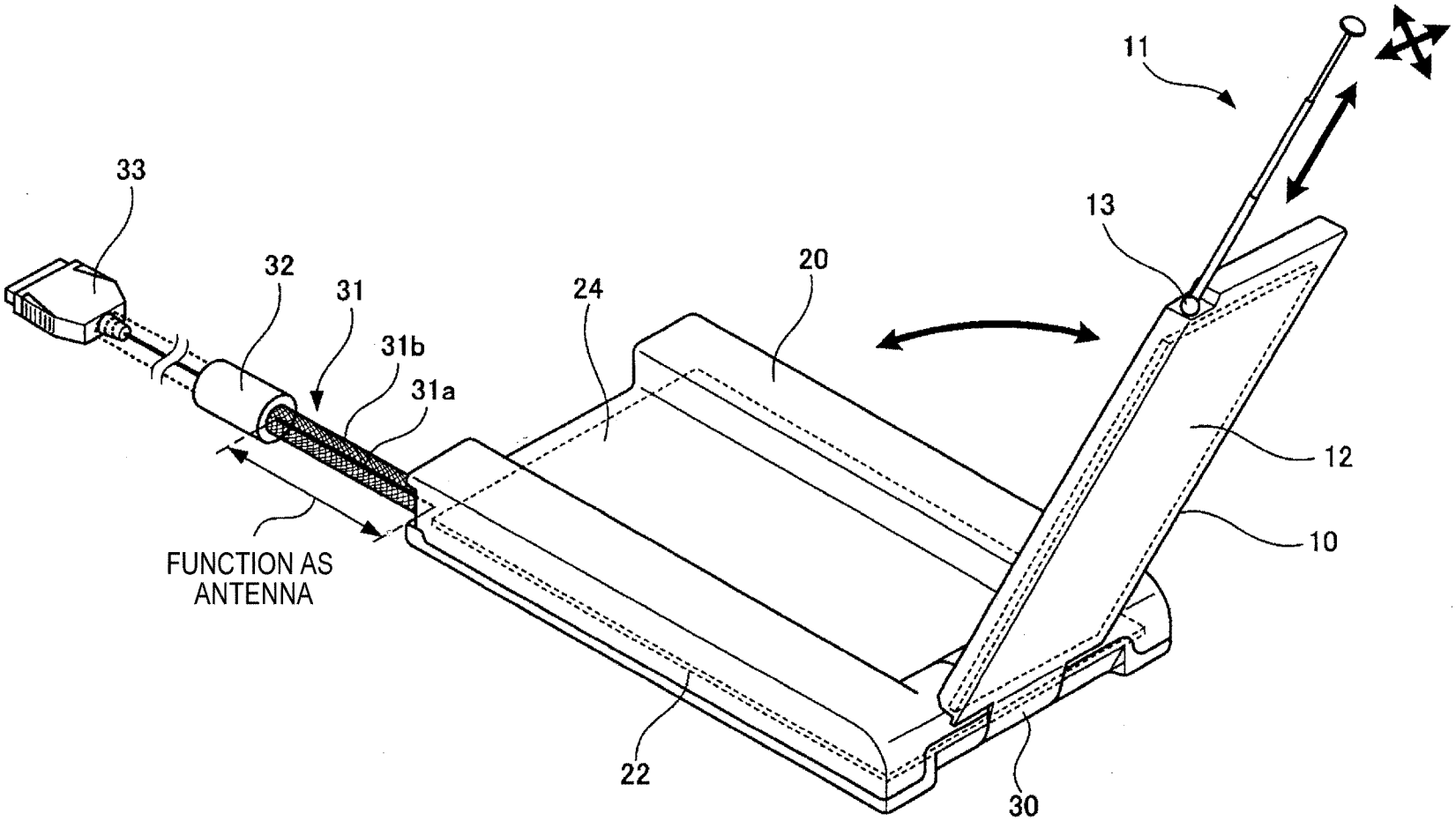
FIG. 11 is a diagram illustrating a schematic configuration of a folding antenna according to a second embodiment of the present disclosure.

The second embodiment illustrated in FIG. 11 differs from the first embodiment illustrated in FIG. 1, in that a coaxial cable 31 having the same length as the rod antenna 21 is used instead of the rod antenna 21 housed in the second case 20. The same reference signs are assigned to the same elements as those in FIG. 1. Therefore, in the second embodiment, only one rod antenna 11 is provided. Since the rod antenna is generally expensive, the folding antenna according to the second embodiment can reduce costs as compared with the folding antenna according to the first embodiment.

[Configuration of Folding Antenna of Second Embodiment]

As illustrated in FIG. 11, in the second embodiment, a coaxial cable 31 and a ferrite core 32 are provided instead of the rod antenna 21 provided at the edge of the second case 20 illustrated in FIG. 1. That is, in the second embodiment, a cladding 31*b* from the edge of the second case 20 to the ferrite core 32 serves as the rod antenna 21 of FIG. 1. In the second embodiment, a length from the case edge of the second case 20 to the ferrite core 32 was set to approximately 140 mm. This length is equal to the length from the case side when the rod antenna 21 of FIG. 1 is extended. The other edge of the coaxial cable is connected to a coaxial connector 33. Since the other configuration is identical to the antenna configuration of the first embodiment, a description thereof is omitted herein.

Here, the reason why the ferrite core 32 and the 140-mm coaxial cable 31 have the same function as the rod antenna 21 of FIG. 1 can be considered as follows. That is, since a high-frequency impedance of the ferrite core 32 is high, it is considered that the coaxial cable 31 until the ferrite core 32 is disconnected from the coaxial cable ahead of the ferrite core 32 in a high-frequency manner. Therefore, a metal conductor corresponding to the cladding 31*b* of the coaxial cable 31 from the edge of the second case 20 to the ferrite core 32 substantially serves as the rod antenna 21 having the function corresponding to one antenna element constituting the dipole antenna. It is obvious that a core 31*a* of the coaxial cable 31 is used as a signal transmission line.

Figure 12:
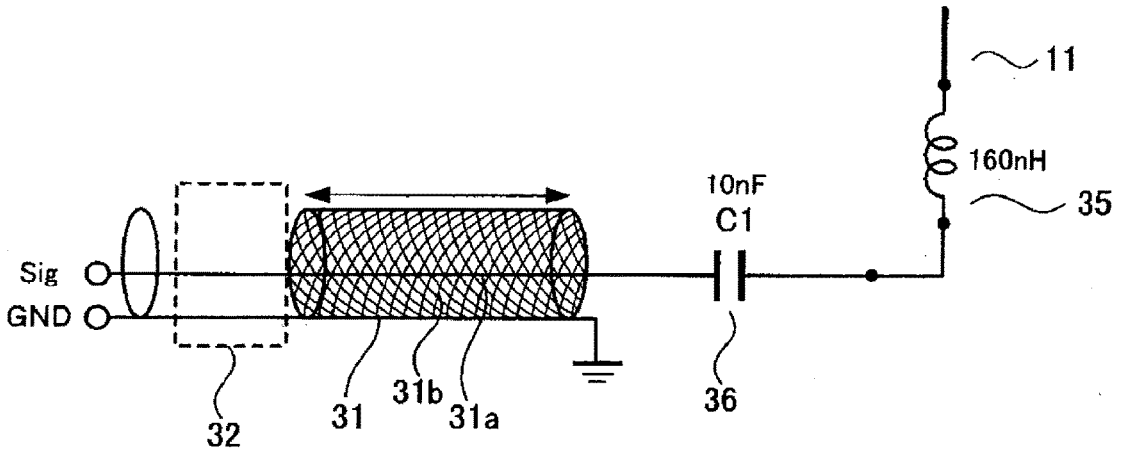
FIG. 12 is a connection relationship between a single rod antenna and a coaxial cable used in a folding antenna according to a second embodiment of the present disclosure.

FIG. 12 illustrates a simplified internal circuit of the second embodiment of FIG. 11. The loading coil 35 is connected to the rod antenna 11, and the other end of the loading coil 35 is connected to the core 31*a* of the coaxial cable 31 through a capacitor 36 for blocking a DC component. In FIG. 12, the balun 26 (see FIG. 2) is not provided, but it is obvious that the balun may also be provided in FIG. 12. Here, in FIG. 12, an inductance of the loading coil 35 connected to the rod antenna 11 was set to 160 nH. The inductance value is a value set upon design so that the electrical length of the rod antenna 11 constituting one antenna element is made substantially equal to the electrical length of the coaxial cable 31 (from the case edge to the ferrite core 32) constituting the other antenna element.

[Frequency-Peak Gain Characteristic of Folding Antenna]

Figure 13:
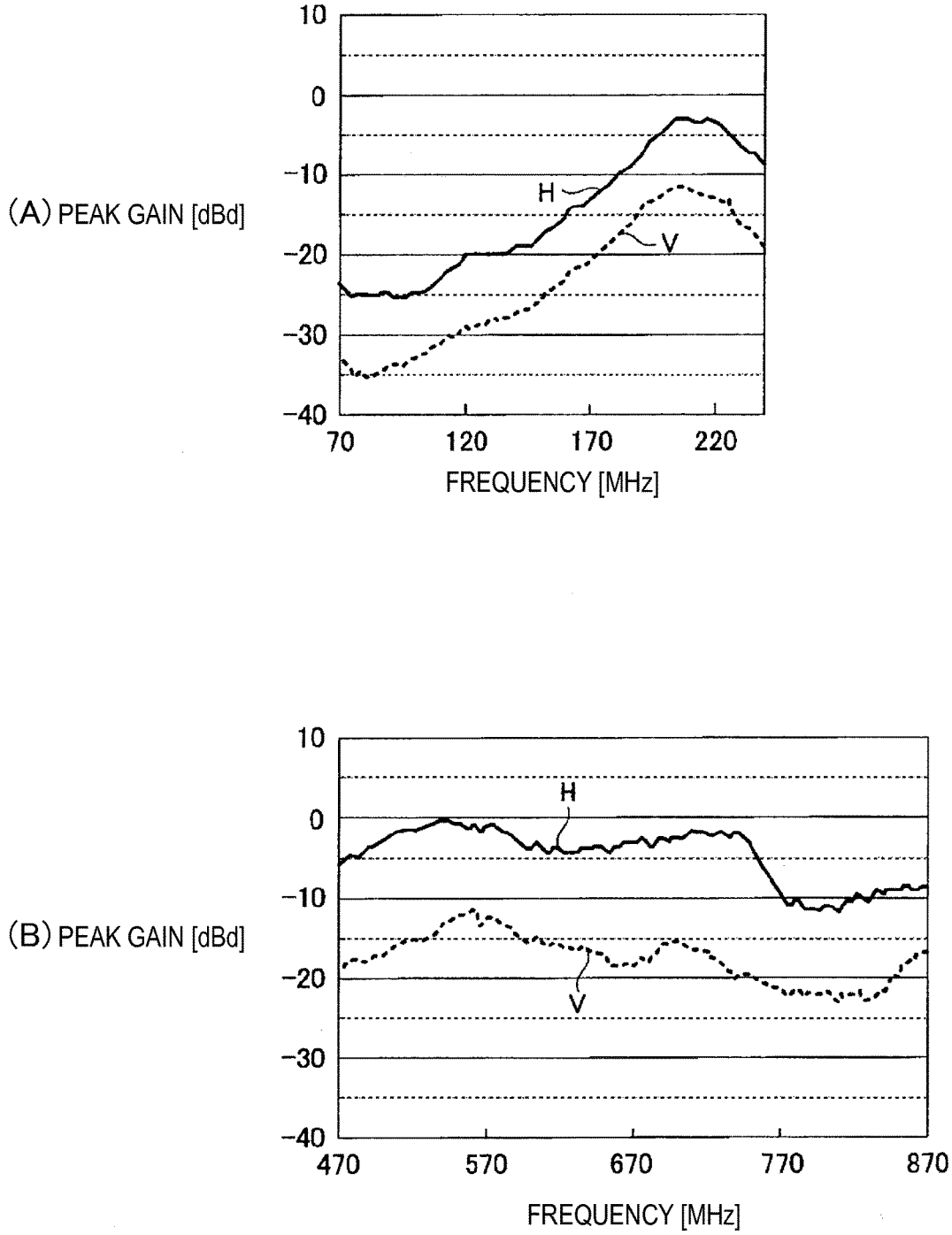
FIGS. 13(A) and 13(B) are diagrams illustrating frequency-peak gain characteristics of a VHF band and a UHF band when a first case and a second case of a folding antenna according to a second embodiment of the present disclosure are opened 180 degrees and rod antennas are extended.
Figure 14:
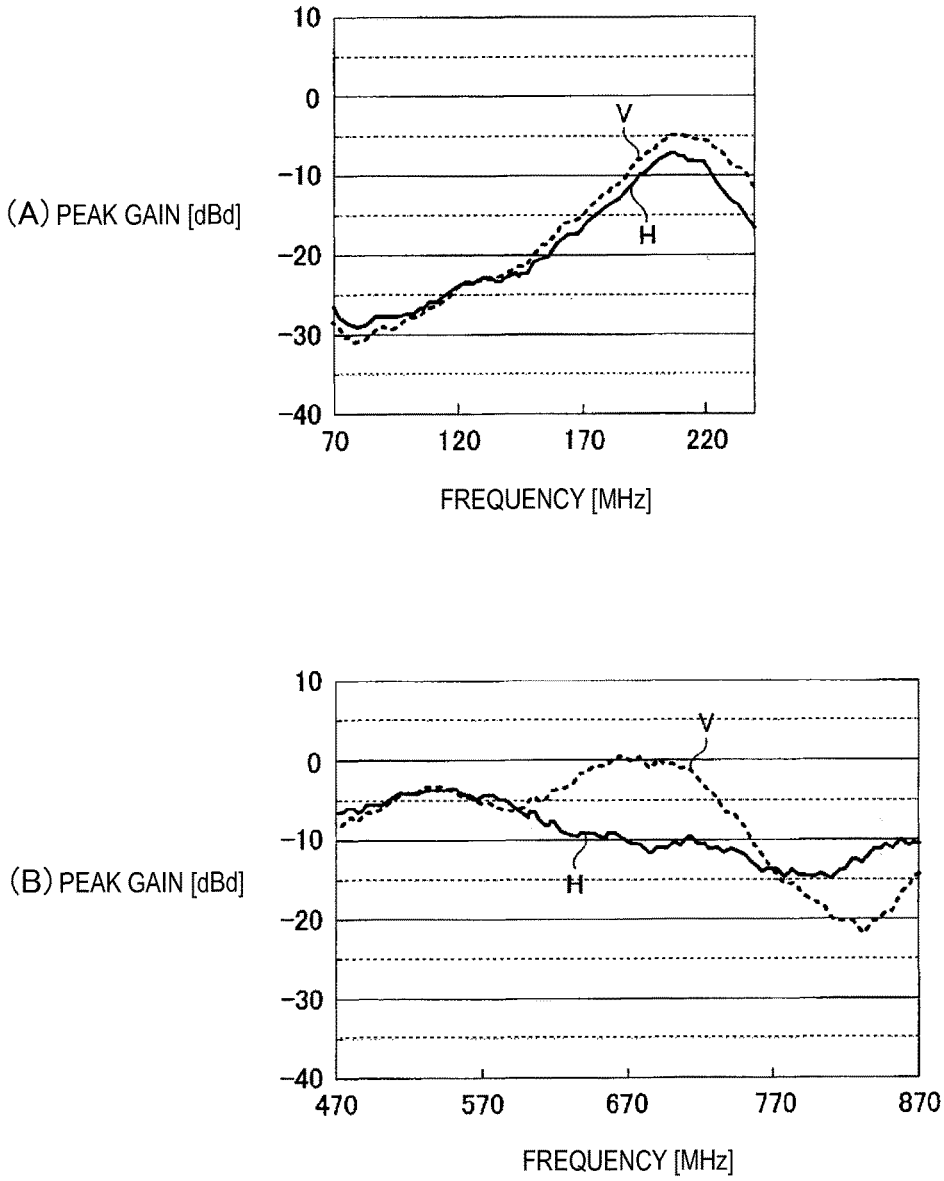
FIGS. 14(A) and 14(B) are diagrams illustrating frequency-peak gain characteristics of a VHF band and a UHF band when a first case and a second case of a folding antenna according to a second embodiment of the present disclosure are opened in a 90-degree L shape and rod antennas are extended.

FIGS. 13 and 14 and Tables 9 to 12 show the antenna characteristic of the second embodiment. As described below, it can be seen that there is a characteristic that can be practically sufficiently used in both the VHF band and the UHF band.

FIG. 13(A) and Table 9 show the frequency-peak gain characteristic of the VHF band when the coaxial cable 31 illustrated in FIG. 11 is used and two cases are opened 180 degrees. Here, an experience was performed using a coaxial cable with a 4-core common axis, but the present disclosure is not limited thereto. A frequency-peak gain characteristic that can also be obtained by a typical 1-core common axis is not changed.

TABLE 9

| Frequency [MHz] | 188.5 | 192.5 | 194.5 | 198 | 204 | 210 | 216 | 222 |
|---|---|---|---|---|---|---|---|---|
| | Vertical Polarization (V) | | | | | | | |
| Peak [dBd] | −15.54 | −13.77 | −13.45 | −12.98 | −11.67 | −11.84 | −12.45 | −13.06 |
| | Horizontal Polarizatin (H) | | | | | | | |
| Peak [dBd] | −8.54 | −6.77 | −6.05 | −5.38 | −3.51 | −3.35 | −3.43 | −3.82 |

FIG. 13(B) and Table 10 show the frequency-peak gain characteristic in the UHF band when the same coaxial cable 31 is used and two cases are opened 180 degrees.

TABLE 10

| Frequency [MHz] | 470 | 520 | 570 | 620 | 670 | 720 | 770 | 906 |
|---|---|---|---|---|---|---|---|---|
| | Vertical Polarization (V) | | | | | | | |
| Peak [dBd] | −18.65 | −15.15 | −12.56 | −15.78 | −18.39 | −16.72 | −21.10 | −16.17 |
| | Horizontal Polarizatin (H) | | | | | | | |
| Peak [dBd] | −5.59 | −1.35 | −1.14 | −4.18 | −3.24 | −1.96 | −8.90 | −8.61 |

As can be seen from FIG. 13(A) and Table 9, a gain of −10 dBd or more is obtained in a horizontal polarization H being a main polarization around 180 to 220 MHz being the high band of the VHF band.

Also, it can be seen from FIG. 13(B) and Table 10 that a gain of approximately −10 dBd or more is ensured in a horizontal polarization H over the entire band of the UHF band of 470 to 900 MHz. Therefore, even when the coaxial cable 31 is used instead of the rod antenna 21 of the second case 20 used in the first embodiment, a slight degradation of a gain is recognized, but it could be understood as being sufficiently endurable to the practical use.

FIG. 14(B) and Table 11 show the frequency-peak gain characteristic in the VHF band when the same coaxial cable 31 is used and two cases are opened in a 90-degree L shape and the rod antenna 11 is extended. Also, FIG. 14(B) and Table 12 show the frequency-peak gain characteristic of the UHF band. The position of the ferrite core 32 is the same as in the case of FIG. 13 and the inductance value of the loading coil 35 is 160 nH as in the case of FIG. 13.

TABLE 11

| Frequency [MHz] | 188.5 | 192.5 | 194.5 | 198 | 204 | 210 | 216 | 222 |
|---|---|---|---|---|---|---|---|---|
| | Vertical Polarization (V) | | | | | | | |
| Peak [dBd] | −10.54 | −8.77 | −8.25 | −7.60 | −5.91 | −5.35 | −5.83 | −6.26 |
| | Horizontal Polarizatin (H) | | | | | | | |
| Peak [dBd] | −12.34 | −10.77 | −10.25 | −9.55 | −7.87 | −7.75 | −8.45 | −9.47 |

TABLE 12

| Frequency [MHz] | 470 | 520 | 570 | 620 | 670 | 720 | 770 | 906 |
|---|---|---|---|---|---|---|---|---|
| | Vertical Polarization (V) | | | | | | | |
| Peak [dBd] | −8.59 | −4.55 | −5.54 | −4.18 | −0.48 | −3.16 | −13.90 | −12.26 |
| | Horizontal Polarizatin (H) | | | | | | | |
| Peak [dBd] | −6.79 | −4.55 | −4.54 | −8.45 | −10.52 | −10.39 | −13.90 | −10.97 |

As can be seen from FIG. 14(A) and Table 11, a gain of −10 dBd or more can be ensured in both the horizontal polarization H and the vertical polarization V, in particular, around 200 to 220 MHz being the high band of the VHF band. However, it was confirmed that the vertical polarization V received using the rod antenna 34 as the antenna had a better frequency-peak gain characteristic than the horizontal polarization H received using the coaxial cable 31 as the antenna.

Also, it can be seen from FIG. 14(B) and Table 12 that a gain of approximately −10 dBd or more is ensured in both the horizontal polarization H and the vertical polarization V until a band of approximately 700 MHz in the UHF band of 470 to 900 MHz. However, in the band of 700 MHz or more, the peak gain characteristic was −10 dBd or less.

It can be seen from FIG. 14(A) and Table 11 that, when an angle between the first case 10 and the second case is opened in an approximately 90-degree L shape, the frequency-peak gain characteristics of the horizontal polarization H and the vertical polarization V in the VHF band are similar to each other. However, it was found from FIG. 14(A) and Table 12 that the frequency-peak gain characteristics of the horizontal polarization H and the vertical polarization V in the UHF band were different from each other. It is considered that this difference is derived from the connection of the loading coil 35 to the rod antenna 34 receiving the vertical polarization V and no connection of the loading coil to the coaxial cable 31. However, the frequency-peak gain characteristic of the horizontal polarization H also maintains a gain of −10 dBd until 470 to 700 MHz and is sufficiently endurable to the practical use.

In the first and second embodiments of the present disclosure, the first case 10 and the second case 20 have been described as the nested structure, but are not limited to the nested structure. Also, in the first and second embodiments of the present disclosure, the DC cutting capacitor is provided, but the capacitor is unnecessary when a DC voltage is not applied to the coaxial signal line. Furthermore, in order to optimize the impedance matching, a matching element may be inserted immediately near the antenna element such as the rod antenna.

Also, in the first and second embodiments of the present disclosure, the loading coil is provided so as to ensure the antenna characteristic in both the VHF and the UHF, but the loading coil is not necessarily required. In the first and second embodiments of the present disclosure, the rod antenna can be retracted and housed in the case, but the rod antenna need not be able to be retracted and housed in the case. Also, in the first and second embodiments of the present disclosure, the antenna capable of receiving both the 200-MHz band of the VHF and the UHF band has been described, but the antenna can be configured to receive different frequency bands by changing the size of the antenna.

The embodiments of the present disclosure have been described above with reference to the accompanying drawings, whilst the present disclosure is not limited to the above embodiments. A person skilled in the art may find various alterations and modifications within the scope of the appended claims, and it should be understood that they will naturally come under the technical scope of the present disclosure.

Additionally, the present technology may also be configured as below.

(1)

A folding antenna device including:

a first case to which a first antenna is attached;

a second case to which a second antenna is attached; and a hinge section configured to openably and closably support the first case and the second case.

(2)

The folding antenna device according to (1), wherein the first antenna takes two states: a state of being housed in the first case and a state of being extended from the first case.

(3)

The folding antenna device according to (2), wherein the second antenna takes two states: a state of being housed in the second case and a state of being extended from the second case.

(4)

The folding antenna device according to (2) or (3), wherein a radio wave of a first frequency band is received in a state in which the first antenna is housed in the first case and the second antenna is housed in the second case, and wherein a radio wave of a second frequency band lower than the first frequency band is received in a state in which the first antenna is pulled out from the first case and the second antenna is pulled out from the second case.

(5)

The folding antenna device according to (4), wherein the first frequency band is a UHF band and the second frequency band is a VHF band.

(6)

The folding antenna device according to any one of (1) to (5), wherein the second case includes a depressed section capable of receiving the first case as nesting.

(7)

The folding antenna device according to any one of (1) to (6), wherein the first antenna and the second antenna are rod antennas having a multi-stage nested structure.

(8)

The folding antenna device according to any one of (1) to (7), wherein the first antenna is a rod antenna, and the second antenna is formed by a coaxial cable, an electrical length of which is substantially equal to an electrical length of the electric first antenna.

(9)

The folding antenna device according to any one of (1) to (8), wherein the first antenna is connected to a first substrate provided in the first case, and the second antenna is connected to a second substrate provided in the second case.

(10)

The folding antenna device according to (9), wherein the first antenna and the second antenna are attached to the first substrate or the second substrate through a loading coil, respectively.

(11)

The folding antenna device according to (9) or (10), wherein the first antenna and the second antenna are attached to the first substrate or the second substrate through a balun, respectively.

(12)

The folding antenna device according to any one of (9) to (11), wherein the first substrate or the second substrate is formed to have a size corresponding to a size of the first case or the second case.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

REFERENCE SIGNS LIST

10 first case
20 second case
11, 21, 34 rod antenna
12, 22 substrate
13, 23 universal joint
15, 25, 35 loading coil
24 depressed section
26 balun (balance-unbalance converter)
27, 36 DC cutting capacitor
28 2.5 ϕmm high-frequency connector
28 hinge section
30 coaxial cable
31 ferrite core
32 coaxial connector
27, 36 DC cutting capacitor

The invention claimed is:

1. A folding antenna device, comprising:

a first case to which a first antenna is attached; a second case to which a second antenna is attached; and a hinge section configured to openably and closably support the first case and the second case, wherein the first antenna and the second antenna are configured to have two states:

a first state in which the first antenna is housed in the first case and the second antenna is housed in the second case, and a second state in which the first antenna is extended from the first case and the second antenna is extended from the second case, and wherein a radio wave of a first frequency band is received in the first state and a radio wave of a second frequency band, lower than the first frequency band, is received in the second state, wherein the second case includes a depressed section configured to receive the first case as a nested structure.

2. The folding antenna device according to claim 1, wherein the first frequency band is a UHF band and the second frequency band is a VHF band.

3. The folding antenna device according to claim 1, wherein the second case further comprises a high-frequency connector configured to output audio.

4. The folding antenna device according to claim 1, wherein the first antenna and the second antenna are rod antennas having a multi-stage nested structure.

5. The folding antenna device according to claim 1, wherein the first antenna is a rod antenna, and the second antenna comprises a coaxial cable, wherein an electrical length of the second antenna is equal to an electrical length of the first antenna.

6. The folding antenna device according to claim 1, wherein the first antenna is connected to a first substrate present in the first case, and the second antenna is connected to a second substrate present in the second case.

7. The folding antenna device according to claim 6, wherein the first antenna is connected to the first substrate through a first loading coil and the second antenna is connected to the second substrate through a second loading coil.

8. The folding antenna device according to claim 6, wherein the first antenna and the second antenna are connected to the first substrate and the second substrate, respectively, through a balun.

9. The folding antenna device according to claim 6, wherein the first substrate has a first size that corresponds to a size of the first case and the second substrate has a second size that corresponds to a size of the second case.

10. The folding antenna device according to claim 1, wherein the hinge section is further configured to lock the first case and the second case, based on an angle between the first case and the second case is 90 degrees.

11. The folding antenna device according to claim 1, wherein the hinge section is further configured to lock the first case and the second case, based on an angle between the first case and the second case is 180 degrees.

* * * * *